US006622887B1

(12) United States Patent
Roediger

(10) Patent No.: US 6,622,887 B1
(45) Date of Patent: Sep. 23, 2003

(54) AUTOMATED MEDICINE DISPENSING APPARATUS

(76) Inventor: Larry Roediger, 4860 Pony Express Trail #3, Camino, CA (US) 95709

( * ) Notice: Subject to any disclaimer, the term of this patent is extended or adjusted under 35 U.S.C. 154(b) by 40 days.

(21) Appl. No.: 10/084,081

(22) Filed: Feb. 27, 2002

(51) Int. Cl.[7] ..... G07F 11/00
(52) U.S. Cl. ..... 221/3; 221/13
(58) Field of Search ..... 221/2, 3, 7, 9, 221/13, 92, 174, 197; 700/242, 244

(56) References Cited

U.S. PATENT DOCUMENTS 5,200,891 A * 4/1993 Kehr et al. ..... 221/2
5,943,241 A * 8/1999 Nichols et al. ..... 700/232

* cited by examiner

*Primary Examiner*—Kenneth W. Noland

(57) ABSTRACT

An automated medicine dispensing apparatus for dispensing an accurate amount of medication at a particular time of the day. The automated medicine dispensing apparatus includes a first housing member being adapted to rest upon a surface and having top, side, bottom, front, and back walls, and also having a first opening being disposed through the front wall; and also includes a drawer being removably disposed in the first housing member through the first opening and having a handle member; and further includes a second housing member being mounted upon the top wall of said first housing member and having front, side, back, and top walls, and also having a plurality of openings being disposed through the front and top walls thereof; and also includes a medicine storage unit being mounted upon the first housing member and being adapted to store medicinal tablets and pills; and further includes a medicine dispensing assembly being disposed in the first and second-housing members for dispensing medicine from the medicine storage unit to the drawer.

9 Claims, 3 Drawing Sheets

AUTOMATED MEDICINE DISPENSING APPARATUS

BACKGROUND OF THE INVENTION

1. Field of the Invention

The present invention relates to medicine dispensers and more particularly pertains to a new automated medicine dispensing apparatus for dispensing an accurate amount of medication at a particular time of the day.

2. Description of the Prior Art

The use of medicine dispensers is known in the prior art. More specifically, medicine dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,747,514; U.S. Pat. No. 5,323,929; U.S. Pat. No. 5,850,937; U.S. Pat. No. 4,911,327; U.S. Pat. No. 5,915,589; U.S. Pat. No. 5,522,525; and U.S. Pat. No. Des. 424,850.

While these devices fulfill their respective, particular objectives and requirements, the aforementioned patents do not disclose a new automated medicine dispensing apparatus.

SUMMARY OF THE INVENTION

The general purpose of the present invention, which will be described subsequently in greater detail, is to provide a new automated medicine dispensing apparatus which has many of the advantages of the medicine dispensers mentioned heretofore and many novel features that result in a new automated medicine dispensing apparatus which is not anticipated, rendered obvious, suggested, or even implied by any of the prior art medicine dispensers, either alone or in any combination thereof. The present invention includes a first housing member being adapted to rest upon a surface and having top, side, bottom, front, and back walls, and also having a first opening being disposed through the front wall; and also includes a drawer being removably disposed in the first housing member through the first opening and having a handle member; and further includes a second housing member being mounted upon the top wall of said first housing member and having front, side, back, and top walls, and also having a plurality of openings being disposed through the front and top walls thereof; and also includes a medicine storage unit being mounted upon the first housing member and being adapted to store medicinal tablets and pills; and further includes a medicine dispensing assembly being disposed in the first and second housing members for dispensing medicine from the medicine storage unit to the drawer.

There has thus been outlined, rather broadly, the more important features of the automated medicine dispensing apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new automated medicine dispensing apparatus which has many of the advantages of the medicine dispensers mentioned heretofore and many novel features that result in a new automated medicine dispensing apparatus which is not anticipated, rendered obvious, suggested, or even implied by any of the prior art medicine dispensers, either alone or in any combination thereof.

Still another object of the present invention is to provide a new automated medicine dispensing apparatus for dispensing an accurate amount of medication at a particular time of the day.

Still yet another object of the present invention is to provide a new automated medicine dispensing apparatus that is easy and convenient to set up and use.

Even still another object of the present invention is to provide a new automated medicine dispensing apparatus that eliminates human errors when taking a prescribed amount of medicine and also aids the user to remember when to take one's proper medication.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
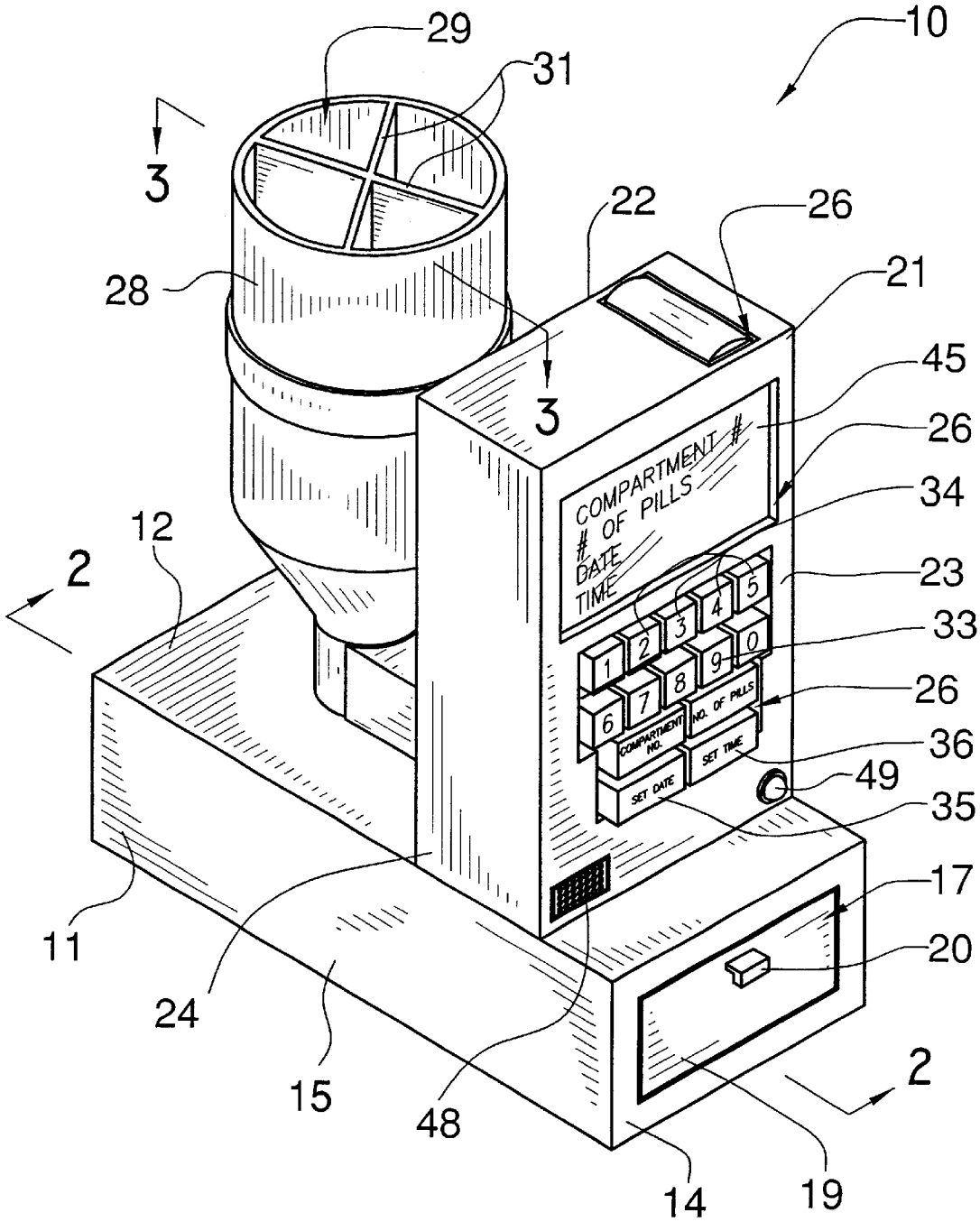
FIG. 1 is a perspective view of a new automated medicine dispensing apparatus according to the present invention and shown in use.
Figure 2:
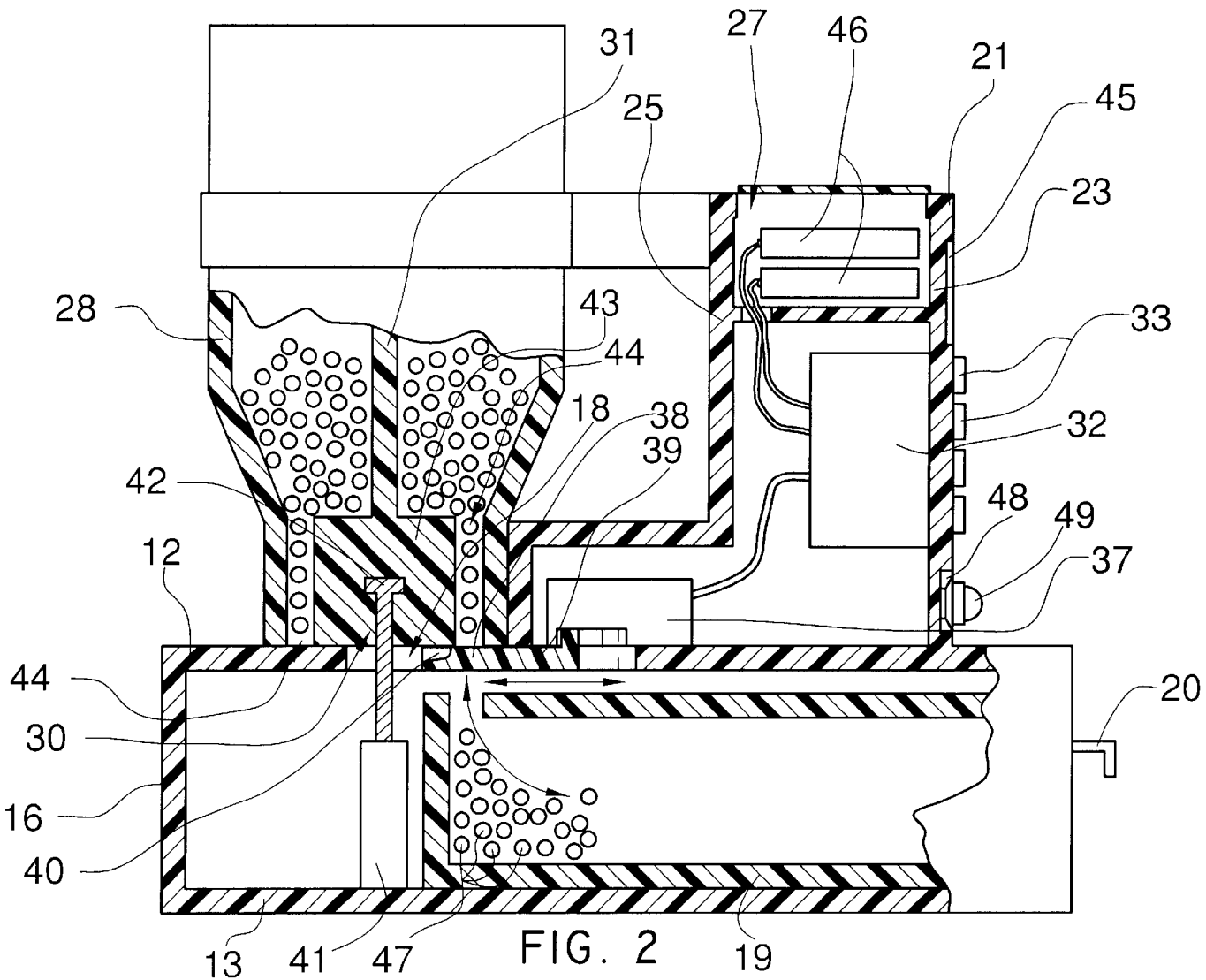
FIG. 2 is a cross-sectional view of the present invention.
Figure 3:
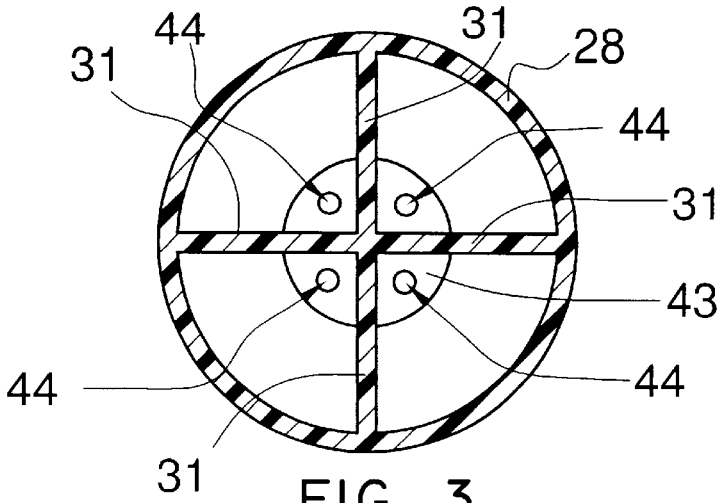
FIG. 3 is a cross-sectional view of the storage unit of the present invention.
Figure 4:
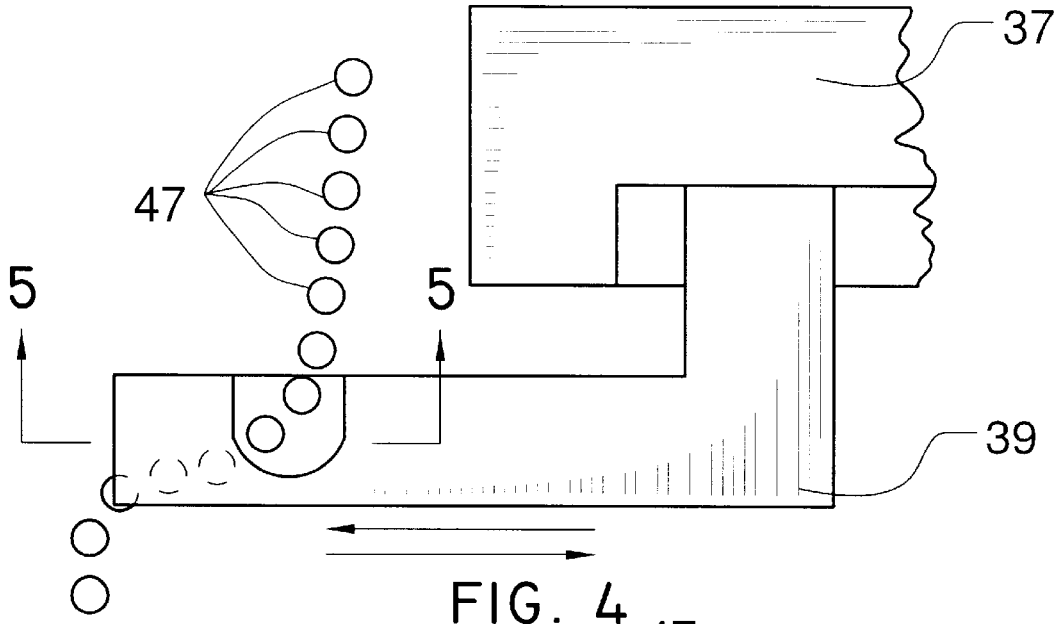
FIG. 4 is a detailed side elevational view of the medicine dispensing member and the medicine counter member of the present invention.
Figure 5:
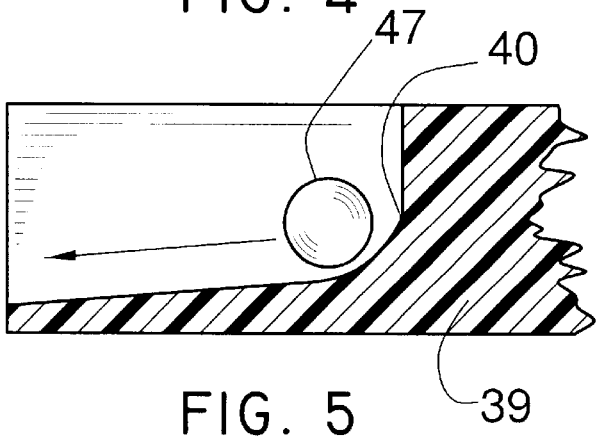
FIG. 5 is a detailed cross-sectional view of the medicine dispensing member of the present invention.

With reference now to the drawings, and in particular to FIGS. 1 through 5 thereof, a new automated medicine dispensing apparatus embodying the principles and concepts of the present invention and generally designated by the reference numeral 10 will be described.

As best illustrated in FIGS. 1 through 5, the automated medicine dispensing apparatus 10 generally comprises a first housing member 11 being adapted to rest upon a surface and having top, side, bottom, front, and back walls 12–16, and also having a first opening 17 being disposed through the front wall 14. The first housing member 11 also has a second opening 18 being disposed through the top wall 12 thereof. A drawer 19 is removably and conventionally disposed in the first housing member 11 through the first opening 17 and has a handle member 20.

A second housing member 21 is conventionally mounted upon the top wall 12 of the first housing member 11 and has front, side, back, and top walls 22–25, and also has a plurality of openings 26 being disposed through the front and top walls 22,23 thereof. The second housing member 21 further includes a battery compartment 27 being conventionally disposed in an upper portion thereof and being accessible through the opening 26 in the top wall 22 thereof.

A storage unit 28 is conventionally mounted upon the first housing member 11 and is adapted to store medicinal tablets and pills 47. The storage unit 28 is generally a hopper having an open top 29 and an open bottom 30. The storage unit 28 also has partitions 31 being conventionally disposed in the hopper and forming a plurality of storage compartments. The storage unit 28 is conventionally mounted over the second opening 18 of the first housing member 11.

A medicine dispensing assembly is conventionally disposed in the first and second housing members 11,21 for dispensing medicine 47 from the storage unit 28 to the drawer 19. The medicine dispensing assembly includes a microprocessor unit 32 being conventionally disposed in the second housing member 21 and being programmed to dispense selected amounts of medicine 47 from the storage unit 28, and also includes a keypad 33 being conventionally disposed upon the front wall 23 of the second housing member 21 and being conventionally connected to the microprocessor unit 32 for selecting compartments and amounts of medicine 47 to be dispensed therefrom, and further includes a medicine dispensing actuator 37 being conventionally disposed in the second housing member 21 and being conventionally connected to the microprocessor unit 32; and also includes a medicine dispensing member 39 being slidably, conventionally and removably disposed over the second opening 18 of the first housing member 11 and being conventionally connected to the medicine dispensing actuator 37, and further includes a sensor 38 being conventionally connected to the medicine dispensing member 39 and to the microprocessor unit 32 for counting the number of the medicine 47 being dispensed from the storage unit 28 through the second opening 18, and also includes a motor 41 being conventionally disposed in the first housing member 11 and being conventionally connected to the microprocessor unit 32 and having a rotatable shaft 42 for selecting compartments from which the medicine 47 is to be dispensed from, and further includes a turntable member 43 being conventionally disposed in the storage unit 28 and being conventionally mounted about the rotatable shaft 42, and also includes a power supply 46 being conventionally disposed in the second housing member 46 and being conventionally connected to the microprocessor unit 32, and further includes a display screen 45 being conventionally disposed in one of the openings 26 in the front wall 23 of the second housing member 21 and being conventionally connected to the microprocessor unit 32 for displaying information keyed in by a user using the keypad 33, and also includes a light-emitting member 49 and a speaker 48 being conventionally disposed upon the front wall 23 of the second housing member 21 and being conventionally connected to the microprocessor unit 32 for indicating time for taking the medicine.

The keypad 33 includes a plurality of numerical keys 34 being depressible for selecting the amount of a particular type of medicine 47 to be dispensed from the storage unit 28, and also includes a date setting key 35, and a time setting key 36. The power supply 46 includes at least one battery. The partitions 31 are conventionally attached upon the turntable member 43; wherein the turntable member 43 includes a plurality of channels 44 for allowing the medicine 47 to be dispensed from the storage unit 28. The medicine dispensing member 39 is a lever being conventionally connected to the medicine dispensing actuator 37 and being removably disposed over the second opening 18 of the first housing member 11 and having a beveled end 40 to allow selected amounts of medicine 47 to be dispensed from the storage unit 28 into the drawer 19.

In use, the user keys in the necessary information as to the type of medicine 47 and the time and date when the medicine 47 is to be dispensed from the storage unit 28 into the drawer 19 using the keypad 33 with the information being displayed upon the display screen 45 for viewing. At the particular time and date, the microprocessor unit 32 will actuate the motor 41 which will rotate the turntable member 43 to select the appropriate compartment from which the medicine is to be dispensed through the appropriate channel 44 and through the second opening 18, and then the microprocessor unit 32 will actuate the medicine dispensing actuator 37 which in turn will actuate the medicine dispensing member 39 to open the second opening 18 upon which a selected number of the medicine 47 will pass through the second opening 18 and will be counted by the sensor 38 and relayed to the microprocessor unit 32. When the correct amount of medicine 47 is dispensed, the microprocessor unit 32 will actuate the medicine dispensing actuator 37 upon which the medicine dispensing member 39 will move over and closed the second opening 18 to prevent anymore medicine 47 to be dispensed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the automated medicine dispensing apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automated medicine dispensing apparatus comprising:

a first housing member being adapted to rest upon a surface and having top, side, bottom, front, and back walls, and also having a first opening being disposed through said front wall;

a drawer being removably disposed in said first housing member through said first opening and having a handle member;

a second housing member being mounted up on said top wall of said first housing member and having front, side, back, and top walls, and also having a plurality of openings disposed through said front and top walls thereof;

a storage unit being mounted upon said first housing member and being adapted to store medicinal tablets and pills; and a medicine dispensing assembly being disposed in said first and second housing members for dispensing medicine from said storage unit to said drawer.

2. An automated medicine dispensing apparatus as described in claim 1, wherein said first housing member also has a second opening being disposed through said top wall thereof.

3. An automated medicine dispensing apparatus as described in claim 2, wherein said storage unit is generally a hopper having an open top and an open bottom, said storage unit also having partitions disposed in said hopper and forming a plurality of storage compartments, said storage unit being mounted over said second opening of said first housing member.

4. An automated medicine dispensing apparatus as described in claim 3, wherein said medicine dispensing assembly includes a microprocessor unit being disposed in said second housing member and being programmed to dispense selected amounts of medicine from said storage unit, and also includes a keypad being disposed upon said front wall of said second housing member and being connected to said microprocessor unit for selecting compartments and amounts of medicine to be dispensed therefrom, and further includes a medicine dispensing actuator being disposed in said second housing member and being connected to said microprocessor unit; and also includes a medicine dispensing member being slidably and removably disposed over said second opening of said first housing member and being connected to said medicine dispensing actuator, and further includes a sensor being connected to said medicine dispensing member and to said microprocessor unit for counting the number of the medicine being dispensed from said storage unit through said second opening, and also includes a motor being disposed in said first housing member and being connected to said microprocessor unit and having a rotatable shaft for selecting compartments from which the medicine is to be dispensed from, and further includes a turntable member being disposed in said storage unit and being mounted about said rotatable shaft, and also includes a power supply being disposed in said second housing member and being connected to said microprocessor unit, and further includes a display screen disposed in one of said openings in said front wall of said second housing member and being connected to said microprocessor unit for displaying information keyed in by a user using said keypad, and also includes a light-emitting member and a speaker being disposed upon said front wall of said second housing member and being connected to said microprocessor unit for indicating time for taking the medicine.

5. An automated medicine dispensing apparatus as described in claim 4, wherein said keypad includes a plurality of numeric keys being depressible for selecting the amount of a particular type of medicine to be dispensed from said storage unit, and also includes a date setting key, and a time setting key.

6. An automated medicine dispensing apparatus as described in claim 5, wherein said second housing member further includes a battery compartment being disposed in an upper portion thereof and being accessible through said opening in said top wall thereof.

7. An automated medicine dispensing apparatus as described in claim 6, wherein said power supply includes at least one battery.

8. An automated medicine dispensing apparatus as described in claim 5, wherein said partitions are attached upon said turntable member; wherein said turntable member includes a plurality of channels for allowing the medicine to be dispensed from said storage unit.

9. An automated medicine dispensing apparatus as described in claim 5, wherein said medicine dispensing member is a lever being connected to said medicine dispensing actuator and being removably disposed over said second opening of said first housing member and having a beveled end to allow selected amounts of medicine to be dispensed from said storage unit into said drawer.

* * * * *